US009976787B2

(12) United States Patent
Bauriedl et al.

(10) Patent No.: US 9,976,787 B2
(45) Date of Patent: May 22, 2018

(54) DEVICE FOR COMMINUTING ICE

(71) Applicants: BSH HAUSGERAETE GMBH, Munich (DE); EMZ-HANAUER GMBH & CO. KGAA, Nabburg (DE)

(72) Inventors: Josef Bauriedl, Neunburg V.W. (DE); Olaf Bayerke, Herbrechtingen (DE); Gerald Schmidt, Gerstetten (DE)

(73) Assignees: BSH Hausgeraete GmbH, Munich (DE); emz-Hanauer GmbH & Co. KGaA, Nabburg (DE)

( * ) Notice: Subject to any disclaimer, the term of this patent is extended or adjusted under 35 U.S.C. 154(b) by 95 days.

(21) Appl. No.: 14/653,391

(22) PCT Filed: Dec. 17, 2013

(86) PCT No.: PCT/EP2013/076873
§ 371 (c)(1),
(2) Date: Jun. 18, 2015

(87) PCT Pub. No.: WO2014/095841
PCT Pub. Date: Jun. 26, 2014

(65) Prior Publication Data

US 2015/0354883 A1 Dec. 10, 2015

(30) Foreign Application Priority Data

Dec. 18, 2012 (DE) ..... 10 2012 223 623

(51) Int. Cl.
*F25C 5/02* (2006.01)
*F25C 5/04* (2006.01)

(52) U.S. Cl.
CPC ..... *F25C 5/046* (2013.01)

(58) Field of Classification Search
CPC ..... F25C 5/046
See application file for complete search history.

(56) References Cited

U.S. PATENT DOCUMENTS

| | | | | |
|---|---|---|---|---|
| 6,109,476 | A | 8/2000 | Thompson et al. | |
| 7,748,230 | B2 | 7/2010 | An | |
| 2006/0144976 | A1* | 7/2006 | Lee | F25C 5/046 62/344 |
| 2010/0251740 | A1 | 10/2010 | Schmidt et al. | |

FOREIGN PATENT DOCUMENTS

| | | | |
|---|---|---|---|
| EP | 1811250 | A2 | 7/2007 |
| WO | 2009049982 | A2 | 4/2009 |

* cited by examiner

*Primary Examiner* — Orlando E Aviles Bosques
(74) *Attorney, Agent, or Firm* — Laurence A. Greenberg; Werner H. Stemer; Ralph E. Locher

(57) ABSTRACT

A device for comminuting ice is particularly suited for a household refrigeration appliance. The device has a rotary shaft, a first cutter unit with at least one fixed blade, and a second cutter unit with at least one moveable blade which is attached to the rotary shaft and can be rotated in a rotational direction. The fixed blade has a comminuting section and a pre-comminuting section which is arranged upstream of the comminuting section counter to the rotational direction.

13 Claims, 6 Drawing Sheets

DEVICE FOR COMMINUTING ICE

BACKGROUND OF THE INVENTION

Field of the Invention

The invention relates to a device for comminuting pieces of ice, in particular for a household refrigerating appliance. The device comprises a rotary shaft, a first knife unit, which has at least one fixed knife, and a second knife unit, which has at least one moveable knife, which is attached to the rotary shaft and can be rotated in a direction of rotation.

In commercially available household refrigerating appliances pieces of ice can be comminuted to crushed ice when ice cubes are dispensed. For this purpose a set of knives comprising a plurality of blades fastened side by side on a shaft is rotatably arranged in a cylindrically shaped housing. A further fixed or fixable set of knives comprising blades that are arranged side by side is arranged in this housing in such a way that the blades of the rotating set of knives can move through the spacings between the fixed blades. During a comminuting process the ice cubes are led through an opening in the housing, wherein the rotating set of knives presses the ice cubes against the fixed set of knives. The pieces of ice are compacted and comminuted by the sets of blades that move towards each other. During this process high torques are required for the rotating knives in order to break the ice cubes so the rotational movement can be performed without blocking.

Brief Summary of the Invention

The object of the invention is to provide an improved device for comminuting pieces of ice.

The invention is achieved by an ice crusher as claimed, and a refrigerating appliance as claimed.

Advantageous embodiments are the subject matter of the dependent claims.

According to the invention a device for comminuting pieces of ice, in particular for a household refrigerating appliance, comprises a rotary shaft, a first knife unit, which has at least one fixed knife, and a second knife unit, which has at least one moveable knife, which is attached to the rotary shaft and can be rotated in a direction of rotation. The fixed knife has a comminuting section and a pre-comminuting section. The pre-comminuting section is arranged upstream of the comminuting section counter to the direction of rotation.

A refrigerating appliance is in particular taken to mean a household refrigerating appliance, i.e. a refrigerating appliance which is used for housekeeping in households or possibly also in the gastronomy sector and serves in particular to store food and/or drink in conventional household quantities at certain temperatures, such as by way of example a refrigerator, freezer, fridge freezer, chest freezer or wine cabinet.

A device for comminuting pieces of ice can be an appliance or a mechanism for comminuting pieces of ice, in which relatively large pieces of ice are broken into smaller pieces by the ice crusher, and can also be called an ice crusher. The device for comminuting pieces of ice can be used in refrigerating appliances, in particular in household refrigerating appliances, as is generally known. The device for comminuting pieces of ice is preferably located on an ice dispenser of the refrigerating appliances or household refrigerating appliance.

The at least one fixed knife of the first knife unit should be immovable with respect to the device for comminuting pieces of ice and/or the household refrigerating appliance. The knife can have a blade that projects radially in a direction away from the rotary shaft, or even two or more blades that project in two directions, for comminuting the pieces of ice per blade. Similarly to the fixed knife, the at least one moveable knife of the second knife unit can also project to one side of the rotary shaft or to both sides thereof. It is also possible for the fixed and moveable knives to have more than two blades. The individual blades of the fixed and moveable knives are preferably equally spaced apart in the direction of rotation. The blades of the fixed knife preferably face the blades of the moveable knife.

The rotary shaft, which is preferably driven by a motor, rotates the second knife unit with respect to the first knife unit. The moveable knife preferably moves past the fixed knife as a result. If a plurality of fixed knives and a plurality of moveable knives are used, then these are preferably arranged alternately, so the moveable knives move through a type of comb of fixed knives. The direction of rotation preferably matches the rotational direction of the rotary shaft.

When comminuting pieces of ice the moveable knives firstly push the ice against the pre-comminuting section and then against the at least one fixed knife or, more precisely, its blade. Pieces of ice can consequently preferably be pre-prepared at the pre-comminuting section, i.e. by way of example very large pieces of ice may be comminuted in order to then finally comminute at the at least one fixed knife the pieces of ice prepared in this way to the desired size. As a result of this pre-preparation step the torque that is to be applied by the moveable knife may be distributed among two positions or crush levels that are spaced apart in the direction of rotation, so a plurality of torque peaks occur and the level of the individual torque peaks may be reduced. This advantageously also produces a more uniform torque distribution on a rotation of the rotary shaft, so the motor driving the rotary shaft is preferably loaded more uniformly. A weaker motor may be used as a result. Weaker motors are often smaller, and this can lead to a cost saving since smaller motors are often less expensive to acquire than larger and more powerful motors.

The fixed knife can either be permanently fixed or it may be fixable, so the fixable knife can move, if this is desired, and may then be fixed. This may be helpful by way of example if a piece of ice has become jammed. The fixable knife can then be detached in order to free the jammed piece of ice.

The device for comminuting pieces of ice preferably comprises a housing and a guide section, which is provided on the fixed knife, wherein the guide section preferably adjoins the housing.

It is also preferred that the guide section is arranged radially outside of the comminuting section with respect to the rotary shaft, projects in a direction counter to the direction of rotation with respect to the comminuting section and tapers counter to the direction of rotation in such a way that the pieces of ice move toward the rotary shaft.

The fixed knife preferably has a guide section and a comminuting section which are formed in particular on each of the blades of the fixed knife. The guide section is arranged radially outside of the comminuting section with respect to the rotary shaft in order to move the ice cubes toward the rotary shaft (i.e. radially inside with respect to the rotary shaft). The pieces of ice are consequently preferably comminuted closer to the rotary shaft so the torque to be applied is lower than if the pieces of ice are comminuted radially further away from the rotary shaft. The guide section preferably has the form of a bent triangle, with the long legs in particular of the bent triangle extending substantially counter to the direction of rotation. The pieces of ice are preferably moved inwards at the radially inwardly bent leg of the triangle.

In particular the radially outer bent leg of the guide section can adjoin the housing. The radially outer bent leg is advantageously substantially curved as much as the housing. This has the advantage in particular of moving pieces of ice, which are furthest radially from the rotary shaft, toward the rotary shaft in order—as shown above—to reduce the torque for comminuting the pieces of ice. A gap may be formed between the guide section and the housing. Alternatively, the guide section can rest on the housing at least in certain regions. The housing comprises in particular a fixed housing part and a pivotal flap. The guide section rests by way of example on the fixed housing part.

It is preferred for the pre-comminuting section to have a pre-comminuting tooth or for the pre-comminuting section to have an arm with at least one pre-comminuting tooth, with the arm projecting radially from the rotary shaft.

It is also preferred for the pre-comminuting section to be arranged radially inside the comminuting section in relation to the rotary shaft. It is also preferred for the arm to have a further guide section and preferably adjoin the housing.

Two preferred embodiments of the pre-comminuting section are therefore being proposed. In one embodiment the pre-comminuting section is a pre-comminuting tooth which is arranged in particular radially inside of the comminuting section. In particular this should mean that the comminuting section is arranged radially outside of the pre-comminuting tooth if they were both pushed in the direction of rotation, so they would point in the same radial direction. The pre-comminuting tooth is arranged upstream of the comminuting section in the direction of rotation, however. The arrangement of the pre-comminuting tooth means the pieces of ice can be pre-processed close to the rotary shaft, so a low torque is required for this.

In the other embodiment the pre-comminuting section has an arm with at least one pre-comminuting tooth. Like the fixed knife, the arm protrudes from the rotary shaft in the radial direction. The arm can firstly have a different design to the blade of the fixed knife or secondly, have a design similar to the blade of the fixed knife. In particular the arm also has a further guide section which has a design similar to the guide section of the fixed knife and in particular also adjoins the housing. The further guide section can be adjacent to the housing via a gap or rest on the housing at least in certain regions. This applies to the arm as well.

Fixed knives with and without pre-comminuting section can be used for the first knife unit, i.e. one of the fixed knives has a pre-comminuting section and a further knife of the first knife unit does not have a pre-comminuting section. The number and arrangement of fixed knives with pre-comminuting section is conceivable in any combination and should in particular be adapted to the requirements of the device for comminuting pieces of ice. It is likewise possible to use fixed knives with a pre-comminuting tooth or an arm, with the combination and number of different pre-comminuting sections or the fixed knives without pre-comminuting section in any conceivable arrangement also being possible here.

It is preferred for the fixed knife to have an opening through which the rotary shaft runs, with the opening preferably having an indentation.

The opening can be designed in such a way that its diameter substantially matches the diameter of the rotary shaft. This has the effect that the fixed knife is mounted on the rotary shaft. Alternatively, the opening can be greater than the rotary shaft, so the fixed knife is not mounted on the rotary shaft.

It is preferred for the moveable knife to have at least one tooth.

Teeth on the moveable knife preferably change the structure of the blade of the moveable knife, so the tips of the teeth tend to touch pieces of ice in the direction of rotation rather than the rest of the blade of the moveable knife. A distribution of the torque in the direction of rotation can consequently be achieved, and this can reduce load peaks on the motor.

It is preferred for the moveable knife to have at least two teeth, with the radially inwardly arranged tooth of two adjacent teeth projecting further in the direction of rotation than the radially outwardly arranged tooth.

This has the advantage in particular that pieces of ice, which are arranged closer to the rotary shaft, are comminuted before pieces of ice, which are arranged further away from the rotary shaft. This advantageously results firstly in a distribution of the torque required for comminuting the pieces of ice over an angular range and secondly, large pieces of ice in particular are comminuted close to the rotary shaft, so the required torque is smaller than if the large pieces of ice are comminuted further away from the rotary shaft. A distribution of the torque over a relatively large angular range preferably reduces the level of the torque peaks and thereby changes for example the resultant noise as well, which is more uniform as a result. This can apply to all possibilities for distributing the torque described here.

The invention also provides a refrigerating appliance, in particular a household refrigerating appliance, which comprises a device for comminuting pieces of ice, as has been described above. The refrigerating appliance consequently has a device for comminuting pieces of ice with the features and advantages described above.

To summarize, the present invention has the advantage that the torque required for comminuting ice cubes can be reduced by gradual comminution of the ice cubes by shaping and arrangement of the knives. An improvement in the noise impression of the comminuting process results and the quality of the crushed ice can be optimized compared to known solutions, moreover.

For this purpose the shaping of the fixed knives is designed in such a way that the guiding and compaction of the ice cubes occurs toward the center of the rotational axis of the knife unit (breaking of the ice cubes close to the rotational axis of the moveable knives requires a lower torque than breaking the ice cubes at a greater spacing from the rotational axis). Individual blades of the fixed knife unit are designed in such a way that a fixed knife is produced upstream of the crushing region of the main plane of the fixed knife (pre-crushing stage). In the comminuting sequence this fixed knife comminutes some of the ice cubes even before the portioned ice cubes are compacted and are comminuted by the blades in the main plane. As a variant the second stage (main plane of a knife) may also be offset to intensify the torque distribution still further.

The moveable knives have a plurality of teeth for breaking the pieces of ice. The shaping of the moveable knives is such that the inner teeth (close to the rotational axis) are longer in shape than the teeth located further out. As a result, pieces of ice, which are located close to the rotational axis of the moveable knives during the comminuting process, are comminuted earlier than pieces of ice that are further removed from the axis. With the same rotational speed the comminuting process is extended over a longer period thereby, and this leads to a reduction and spreading of the torque curve.

The ice can be comminuted with a lower maximum torque in one pass due to the invention. A more uniform torque characteristic with lower variations in load for the drive is achieved for the comminuting process. This has an advantageous effect on the constructional design of the comminuting mechanisms and their drive. The noise impression of the comminuting process is also more uniform. The drive can therefore also have smaller dimensions, and this can lead to a cost saving since smaller motors are often less expensive to acquire than larger and more powerful motors.

BRIEF DESCRIPTION OF THE SEVERAL VIEWS OF THE DRAWING

Specific embodiments of the invention shall be described with reference to the following drawings, in which.

DESCRIPTION OF THE INVENTION

Figure 1:
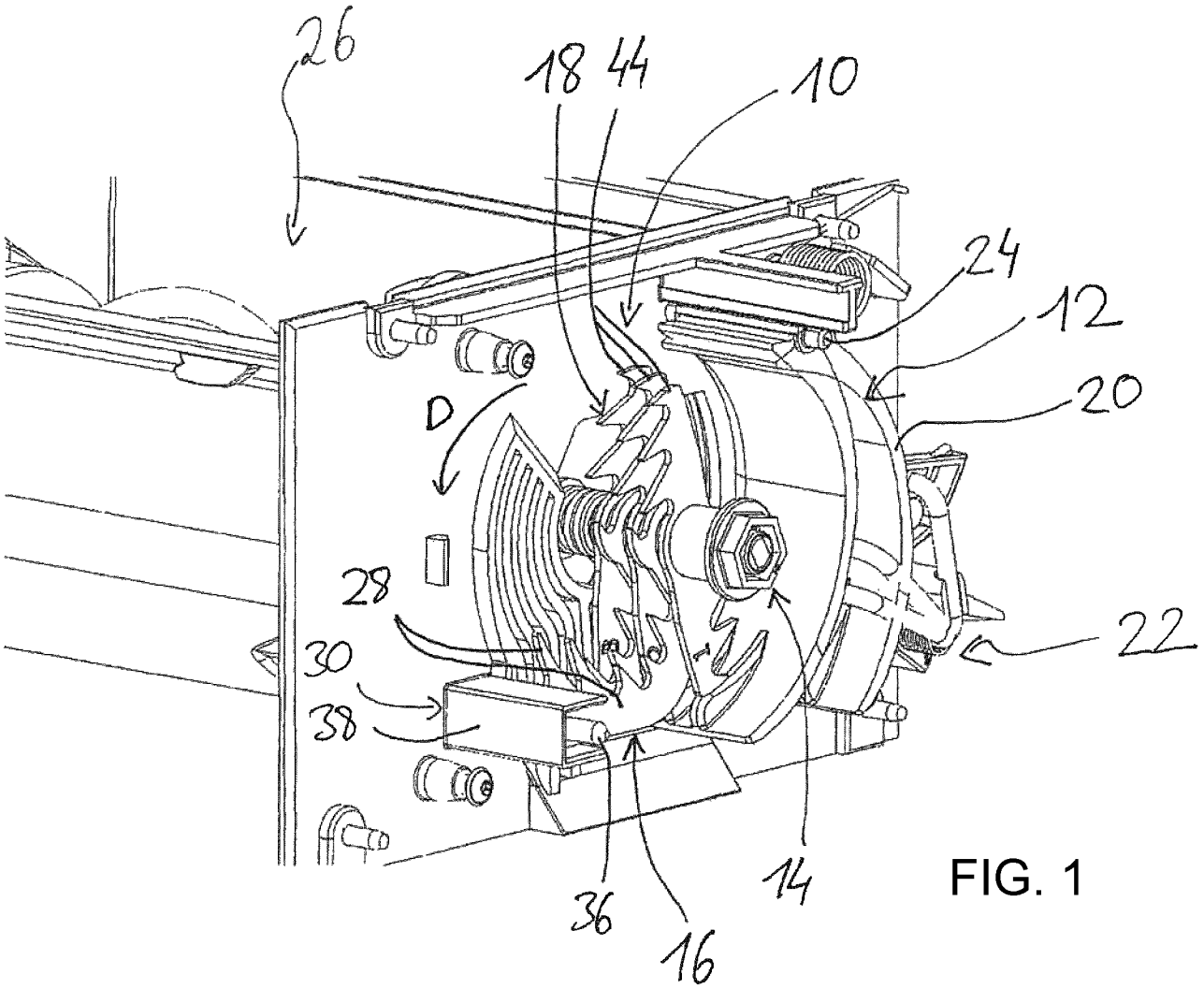
FIG. 1 shows a perspective view of a device for comminuting pieces of ice, wherein a fixed housing part of a housing is removed for clarity.

A device for comminuting pieces of ice 10 has a housing 12, of which only a part, a pivotal flap 20, is shown in the figures, a rotary shaft 14, a first knife unit 16 and a second knife unit 18. The knife units 16, 18 can also be called knife sets. The housing 12 has a fixed housing part which is not shown in FIGS. 1 to 3, and the pivotal flap 20. The fixed housing part and the pivotal flap 20 delimit the device for comminuting pieces of ice on all sides.

The pivotal flap 20 can be pivoted by a pivoting mechanism 22 about a pivot axis 24 into a first dispensing position and a second dispensing position. In the first dispensing position of the flap 20, the flap 20 is not completely closed and pieces of ice comminuted by means of the knife units 16, 18 can fall out of the device 10, and this enables crushed ice to be dispensed. In the second dispensing position, in which the flap 20 is pivoted into a more open position, uncomminuted or whole pieces of ice can fall through the device for comminuting pieces of ice 10 without being comminuted.

The device for comminuting pieces of ice 10 is arranged on an ice dispenser 26 whose construction is known to a person skilled in the art. The ice dispenser is connected to an ice maker whose construction is also known to a person skilled in the art.

Figure 2:
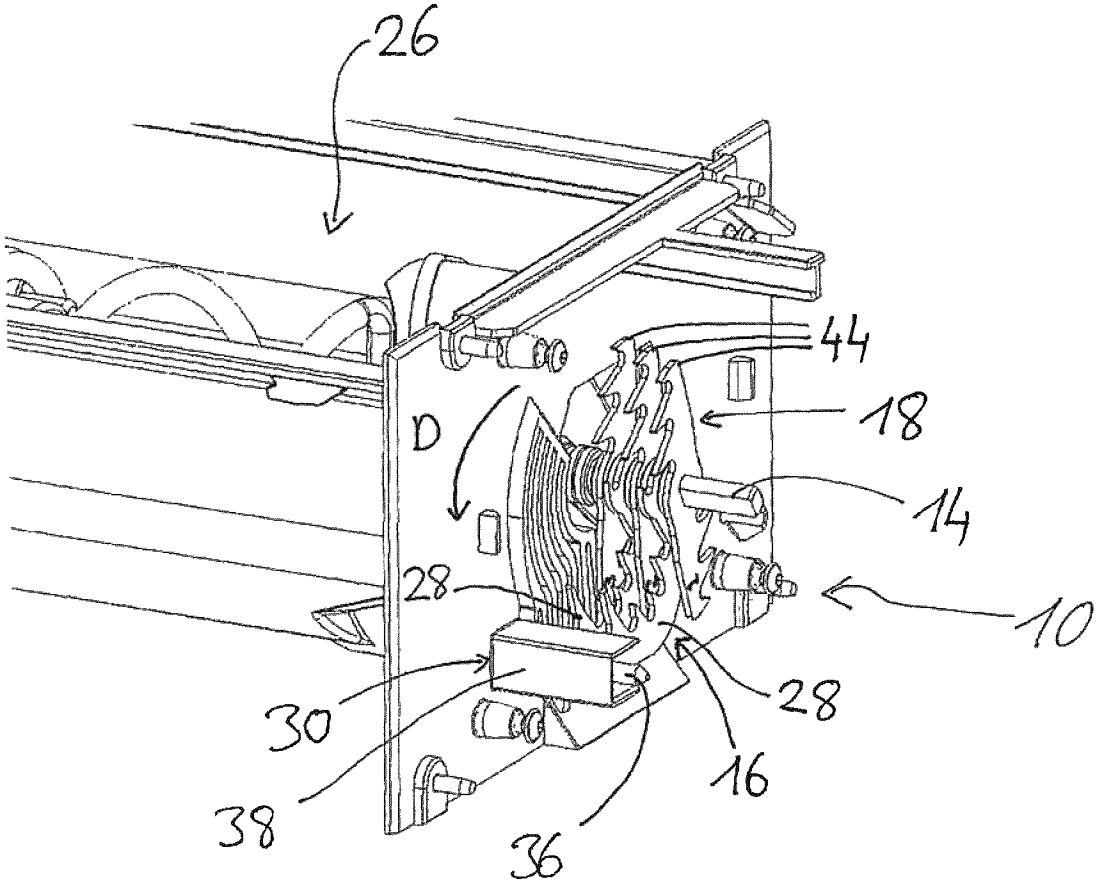
FIG. 2 shows a perspective view of the device for comminuting pieces of ice without the housing.
Figure 3:
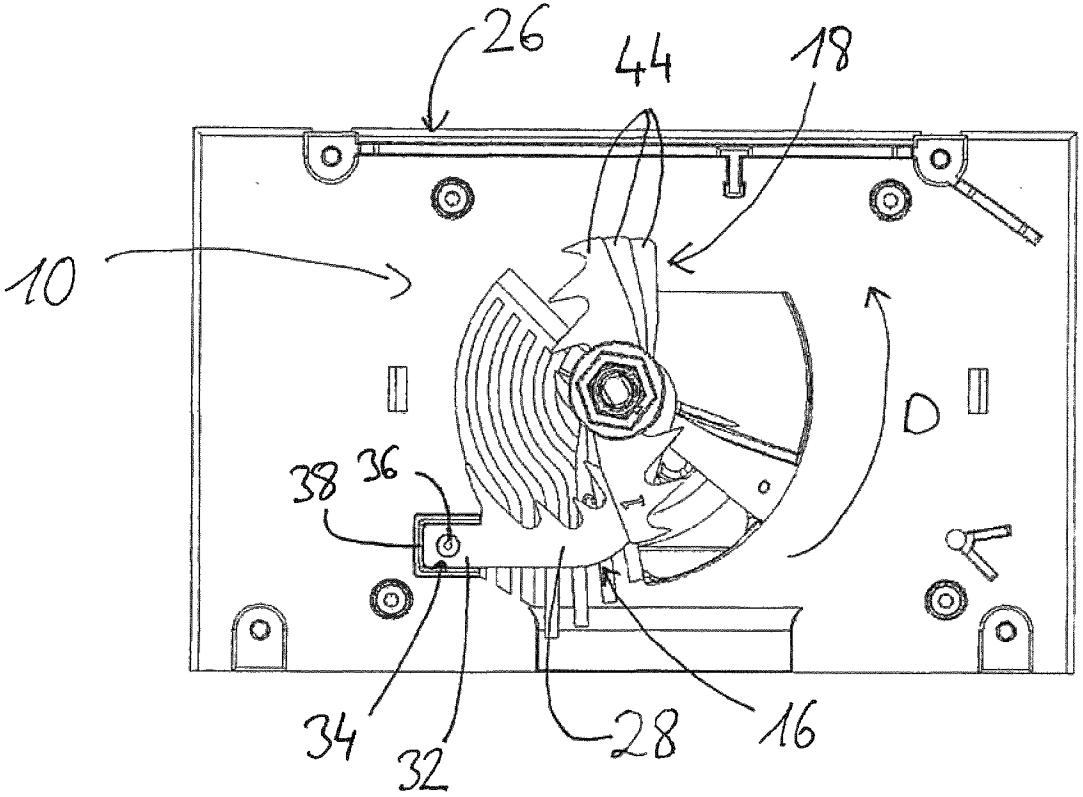
FIG. 3 shows a plan view of the device for comminuting pieces of ice without the housing.

The first knife unit 16 in FIGS. 1 and 2 has two fixed knives 28. The fixed knives 28 are attached to the rotary shaft 14 and to a fastening section 32 of the housing 12 of the device for comminuting pieces of ice 10. As may be seen in FIG. 3 in particular, at one end the fixed knives 28 have a fastening section 32 with a fastening opening 34. The fastening 32 is pushed onto a fastening mechanism 30 of the housing 12 which has a fastening shaft 36 and a fastening frame 38. In particular the fastening opening 34 rests flush on the fastening shaft 36, just as the fastening frame 38 rests flush in particular on the fastening section 32. This provides a non-rotatable fastening of the fixed knife 28, which may also be designed so as to be slightly resilient.

At the other end the two fixed knives 28 have an opening 40 with an indentation 42. The opening 40 has an internal diameter ID which substantially matches the external diameter of the axis of rotation 14. This is helpful for simple assembly in particular.

In the exemplary embodiments shown in FIGS. 1 and 2 the second knife unit comprises three moveable knives 44. The moveable knives 44 are non-rotatably mounted on the rotary shaft 14 and rotate with the rotary shaft 14. The rotary shaft 14 is driven by a motor (not shown). For fastening to the rotary shaft 14 the three moveable knives 44 have a bearing opening 46 which substantially has a rectangular cross-section. The rotary shaft 14 also has a rectangular cross-section in the region of the fastening of the moveable knives 44, so torques can be transferred from the rotary shaft 14 to the moveable knives 44 and vice versa.

The moveable knives 44 are arranged on the rotary shaft 14 in such a way that they run through the fixed knives 28 in the manner of a comb. The spacing between the moveable knife 44 and the fixed knife 28 is adjusted during assembly of the device for comminuting pieces of ice 10 according to the desired size of the comminuted pieces of ice.

Figure 4:
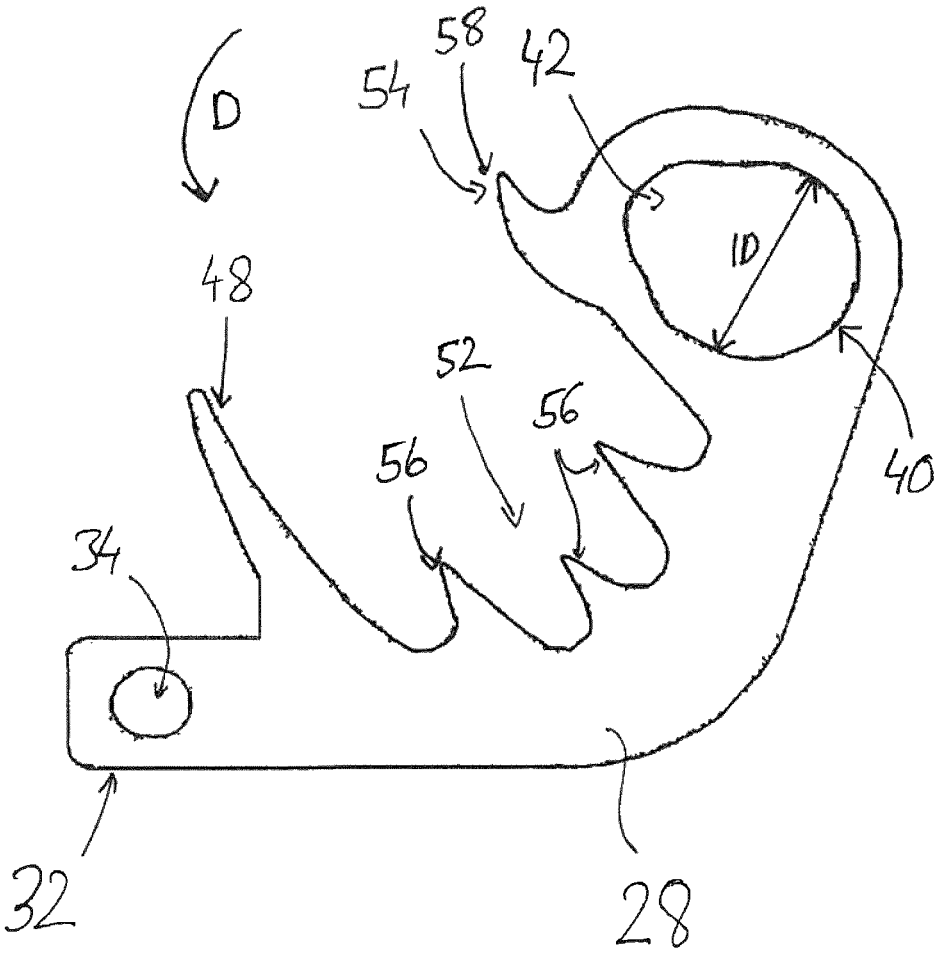
FIG. 4 shows a first embodiment of a fixed knife.
Figure 5:
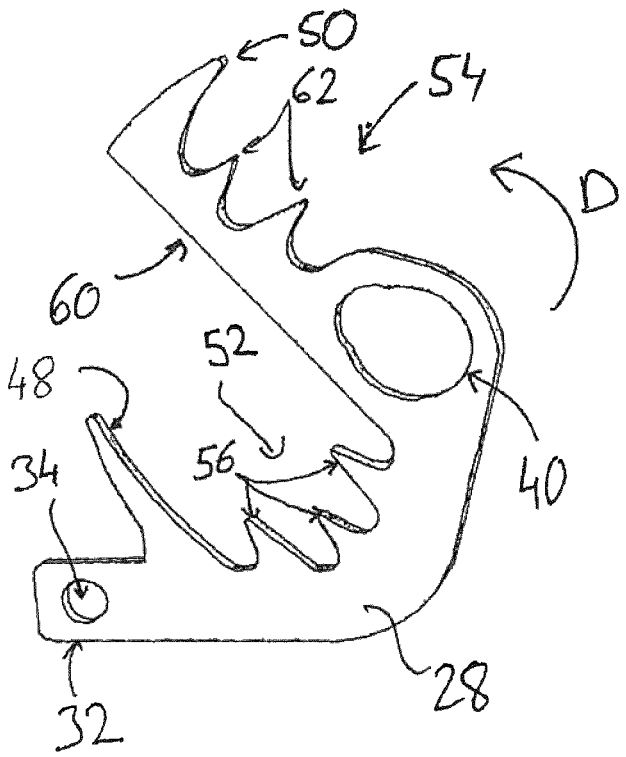
FIG. 5 shows a second embodiment of a fixed knife.
Figure 6:
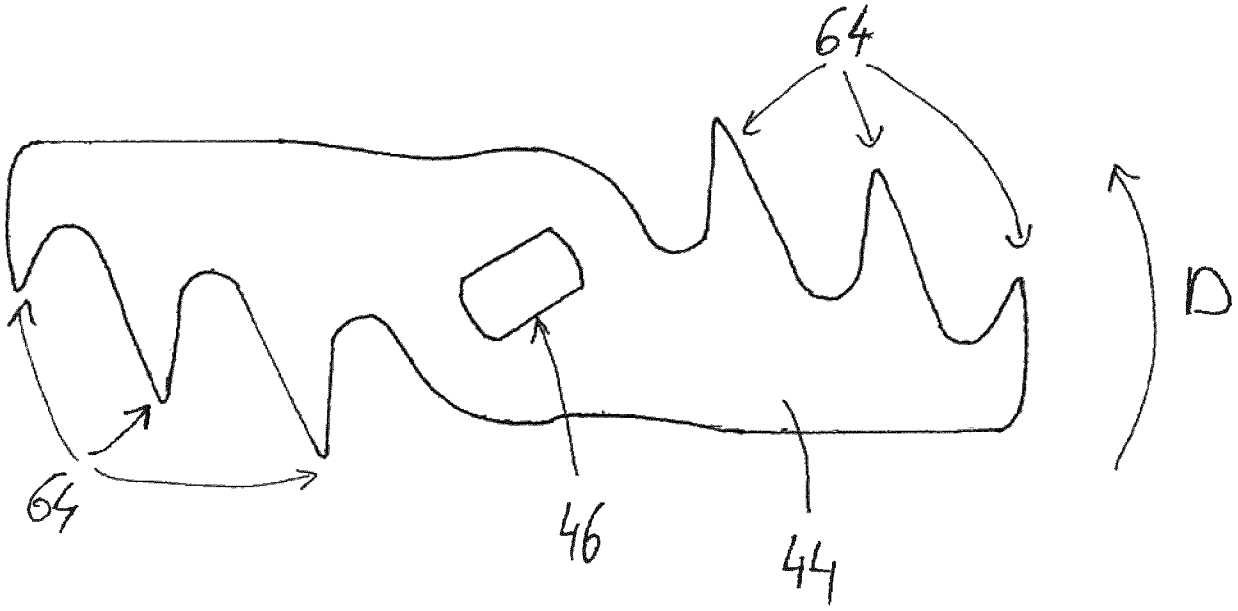
FIG. 6 shows a moveable knife.

As may clearly be seen in FIGS. 4 and 5, the fixed knife 28 has the fastening section 32, the opening 40, a guide section 48, a comminuting section 52 and a pre-comminuting section 54. The guide section 48 projects from the comminuting section 52 counter to the direction of rotation D. The guide section 48 is shaped similarly to a bent triangle and tapers in the direction counter to the direction of rotation D. As may be seen from FIGS. 1 and 2, the guide section 48 adjoins the fixed housing part of the housing 10.

The comminuting section 52 has comminuting teeth 56 which are part of the blade of the fixed knife 28. The comminuting teeth 56 extend less far counter to the direction of rotation than the guide section 48. The comminuting teeth 56 are used to comminute pieces of ice at various positions along the direction of rotation D in order to therefore spread the torque acting on the motor along the direction of rotation D.

In the embodiment of the fixed knife 28 shown in FIG. 4 the pre-comminuting section 54 comprises or is a pre-comminuting tooth 58. The pre-comminuting section 54 is arranged upstream of the comminuting section 52 in the direction of rotation D. The pre-comminuting tooth 58 is arranged radially inside the pre-comminuting section 52 with respect to the rotary shaft 14.

In the embodiment shown in FIG. 5 the pre-comminuting section 54 comprises or is an arm 60 with two pre-comminuting teeth 62 and a further guide section 50. Otherwise the fixed knife 28 is identical to the fixed knife 28 in FIG. 4. The arm 60 is again arranged upstream of the comminuting section 52 in the direction of rotation D. The pre-comminuting teeth 62 have a similar design to the comminuting teeth 56 and are used for the same purpose. The further guide section 50 of the arm 60 has a similar design to the guide section 48 and is used for a similar purpose. In particular the further guide section 50 of the arm 60 also adjoins the fixed housing parts of the housing 12.

The moveable knife 44 has two blades on which three teeth respectively, or also called blade teeth 64, are arranged. The blades protrude radially from the rotary shaft 14 or the opening 40 on two sides and enclose a 180° angle with each other. The bearing opening 46 is arranged in the center. The blade teeth 64 protrude in the direction of rotation D to different extents. A blade tooth 64 arranged radially further out protrudes less far in the direction of rotation D than a blade tooth 64 arranged radially further in.

The mode of operation of the device for comminuting pieces of ice 10 shall now be described below.

Pieces of ice are moved from the ice dispenser 26 into the device for comminuting pieces of ice 10. The second blade unit 18 is moved by the rotary shaft 14. The pieces of ice are consequently moved in the direction of rotation D toward the first knife unit 16. Larger pieces of ice in particular are pre-processed and in particular comminuted at the pre-comminuting section 54 and the second knife unit 18. The pre-processed pieces of ice are then moved further toward the first knife unit 16 and comminuted between the first knife unit 16 and the second knife unit 18. Since the flap 20 is in the first dispensing position, the comminuted pieces of ice then fall out of the device for comminuting pieces of ice 10 since the flap is not completely closed in the first dispensing position of the housing 12.

During comminution the blade teeth 64 arranged further in and which protrude further first strike the pieces of ice firmly held by the fixed knife 28, so first pieces of ice close to the rotary shaft 14 are comminuted. A lower torque is required for this than in the case of pieces of ice further removed from the rotary shaft 14.

Furthermore, the pieces of ice are comminuted offset in the direction of rotation D, so the torque required for comminution is distributed over a larger angular range along the direction of rotation D. The torque peaks can be reduced in this way. Furthermore, the pieces of ice are moved toward the rotary shaft 14 when they strike the guide section 48, so they are comminuted closer to the rotary shaft 14. This reduces the required torque. The comminuting section 52 with its comminuting teeth 56 does not comminute the pieces of ice at one point in the direction of rotation either, so torque peaks can also be distributed and be reduced thereby.

LIST OF REFERENCE CHARACTERS

10 device for comminuting pieces of ice
12 housing
14 rotary shaft
16 first knife unit
18 second knife unit
20 pivotal flap
22 pivotal mechanism
24 pivot axis
26 ice dispenser
28 fixed knife
30 fastening device
32 fastening section
34 fastening opening
36 fastening shaft
38 fastening frame
40 opening
42 indentation
44 moveable knife
46 bearing opening
48 guide section
50 further guide section
52 comminuting section
54 pre-comminuting section
56 comminuting teeth
58 pre-comminuting tooth
60 arm
62 pre-comminuting tooth
64 blade teeth
D direction of rotation
ID internal diameter

The invention claimed is:

1. A device for comminuting pieces of ice, comprising:
a rotary shaft;
a first knife unit having at least one fixed knife, said fixed knife being formed with a comminuting section and a pre-comminuting section;
and
a second knife unit having at least one moveable knife attached to said rotary shaft for rotation in a direction of rotation;
said second knife unit being configured to first push the ice against said pre-comminuting section and then against said comminuting section of said first knife unit;
wherein said pre-comminuting section of said at least one fixed knife is arranged upstream of said comminuting section counter to the direction of rotation, and said pre-comminuting section has a pre-comminuting tooth or an arm carrying at least one pre-comminuting tooth, and wherein said arm projects radially away from said rotary shaft;
said at least one fixed knife having:
a first end;
a second end, opposite to the first end;
said first end comprising a fastening section, the fastening section having a first opening, and a fastening shaft arranged within the first opening that prevents rotation of said at least one fixed knife;
said second end comprising a solid section with a second opening passing through the solid section; wherein said rotary shaft is placed within said second opening;
wherein said second end further comprises said pre-comminuting section projecting from said solid section; and said comminuting section is located in a concave portion between the first end and the second end of said at least one fixed knife.

2. The device for comminuting pieces of ice according to claim 1 configured for a household refrigeration appliance.

3. The device for comminuting pieces of ice according to claim 1, which comprises a housing and a guide section formed on said fixed knife.

4. The device for comminuting pieces of ice according to claim 3, wherein said guide section of said fixed knife adjoins said housing.

5. The device for comminuting pieces of ice according to claim 3, wherein said guide section is disposed radially outside of said comminuting section with respect to said rotary shaft, projects in a direction counter to the direction of rotation with respect to said comminuting section, and tapers counter to the direction of rotation such that the pieces of ice move towards said rotary shaft.

6. The device for comminuting pieces of ice according to claim 1, wherein said pre-comminuting tooth is arranged radially inside said comminuting section with respect to said rotary shaft.

7. The device for comminuting pieces of ice according to claim 1, wherein said arm has a further guide section.

8. The device for comminuting pieces of ice according to claim 1, wherein said arm adjoins a housing of the device.

9. The device for comminuting pieces of ice according to claim 1, wherein said at least one moveable knife has at least one tooth.

10. The device for comminuting pieces of ice according to claim 9, wherein at least one moveable knife has at least two adjacent teeth, one of said at least two teeth is a radially inwardly arranged tooth projecting in the direction of rotation, adjacent a second of said at least two teeth that is a radially outwardly arranged tooth projecting in the direction of rotation, and wherein said radially inwardly arranged tooth of two adjacent teeth projects farther than the radially outwardly arranged tooth in the direction of rotation.

11. A refrigeration appliance, comprising a device for comminuting pieces of ice according to claim 1.

12. A household refrigeration appliance, comprising a device for comminuting pieces of ice according to claim 1.

13. A method for comminuting pieces of ice, the method comprising:

providing a first knife unit having at least one fixed knife, the fixed knife being formed with a comminuting section and a pre-comminuting section;

providing a rotary shaft, and a second knife unit having at least one moveable knife attached to the rotary shaft for rotation in a direction of rotation, where the pre-comminuting section of the at least one fixed knife is arranged upstream of said comminuting section counter to the direction of rotation;

providing a pre-comminuting tooth or an arm carrying at least one pre-comminuting tooth on said pre-comminuting section, the arm projecting radially away from said rotary shaft using the second knife unit to firstly push ice against the pre-comminuting section when ice is received; and using the second knife unit to secondly push the ice against the comminuting section of the first knife unit;

said at least one fixed knife having:

a first end;

a second end, opposite to the first end;

said first end comprising a fastening section, the fastening section having a first opening, placing a fastening shaft within the first opening that prevents rotation of said at least one fixed knife;

said second end comprising a solid section with a second opening passing through the solid section;

placing the rotary shaft within said second opening;

wherein said second end further comprises said pre-comminuting section projecting from said solid section; and said comminuting section is located in a concave portion between the first end and the second end of said at least one fixed knife.

* * * * *